US005771739A

United States Patent [19]

Hinson

[11] Patent Number: 5,771,739

[45] Date of Patent: Jun. 30, 1998

[54] AUTOMATIC CHAIN LOCK

[76] Inventor: Virgil H. Hinson, 373 Choctaw Sq., Brunswick, Ga. 31525

[21] Appl. No.: 787,314

[22] Filed: Jan. 24, 1997

[51] Int. Cl.[6] ..... B21D 1/12

[52] U.S. Cl. ..... 72/447; 72/705

[58] Field of Search ..... 72/457, 705, 447, 72/372

[56] References Cited

U.S. PATENT DOCUMENTS

| | | | |
|---|---|---|---|
| 4,386,517 | 6/1983 | Harmon | 72/705 |
| 5,146,775 | 9/1992 | Ballard et al. | 72/705 |
| 5,257,526 | 11/1993 | Teixeria | 72/705 |
| 5,415,023 | 5/1995 | Hinson | 72/705 |
| 5,640,878 | 6/1997 | Hinson | 72/705 |

*Primary Examiner*—Lowell A. Larson
*Assistant Examiner*—Ed Tolan
*Attorney, Agent, or Firm*—James B. Middleton

[57] ABSTRACT

An automatic chain lock allows successive pulls on a vehicle on a straightening apparatus without manipulation of the chain lock between actuations of the fluid cylinder. A pair of gates provides a ratchet arrangement for the chain, the lower gate holding the chain while the lower gate is moved down to pull the chain and cause the chain to ratchet through the upper gate; and, when the movement reaches its end, the upper gate secures the chain while the chain ratchets through the lower gate. The procedure is then repeated, the lower gate again moving down to make another pull on the vehicle. Each gate has a pair of flanges that pivot down, but are held against pivoting up. The two gates are arranged with respect to each other so that each will engage a link of the chain at the appropriate time in the cycle.

8 Claims, 1 Drawing Sheet

AUTOMATIC CHAIN LOCK

BACKGROUND OF THE INVENTION

1. Field of the Invention

This invention relates generally to vehicle straightening apparatus, and is more particularly concerned with an automatic chain lock for making successive pulls from a pull tower on a straightening apparatus.

2. Discussion of the Prior Art

It is well known to provide a vehicle straightening apparatus wherein a vehicle to be straightened is fixed to a platform, and one or more pull towers adjacent to the platform exert forces on the vehicle through chains connected to the vehicle. In the conventional apparatus, the pull tower includes a chain lock. The chain is connected to the vehicle, generally passes over a pulley on the pull tower, and is fixed by means of the chain lock. One then makes a pull, usually by a hydraulic cylinder or the like. After one stroke of the cylinder, if further motion of the vehicle part is required, the cylinder is retracted, and the chain lock must be manually released, the chain pulled taut, and the chain lock re-fastened. A second pull can then be made. Subsequent pulls each require the above described series of steps.

Thus, the prior art chain locks are time consuming to use because considerable manual work must be done between successive pulls for a given set-up.

SUMMARY OF THE INVENTION

The present invention provides an automatic chain lock for use on a vehicle straightening apparatus, the chain lock including a pair of gates spaced from each other along the length of the chain to be held. Each gate is oriented to hold a chain link having a particular orientation, and the gates are spaced apart the proper distance to engage the appropriate link. Each gate allows movement of the chain therethrough in a first direction and prevents movement in the opposite direction. Thus, one gate holds the chain while that gate is moved to make a pull on a vehicle being straightened; and, the chain passes freely through the other gate. At the end of the pull, the one gate moves oppositely while the other gate holds the chain. These actions can be repeated successively until the desired amount of straightening has been accomplished. The only manual manipulation of the chain lock of the present invention required is to release the chain when the connection of the chain to the vehicle is to be changed.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
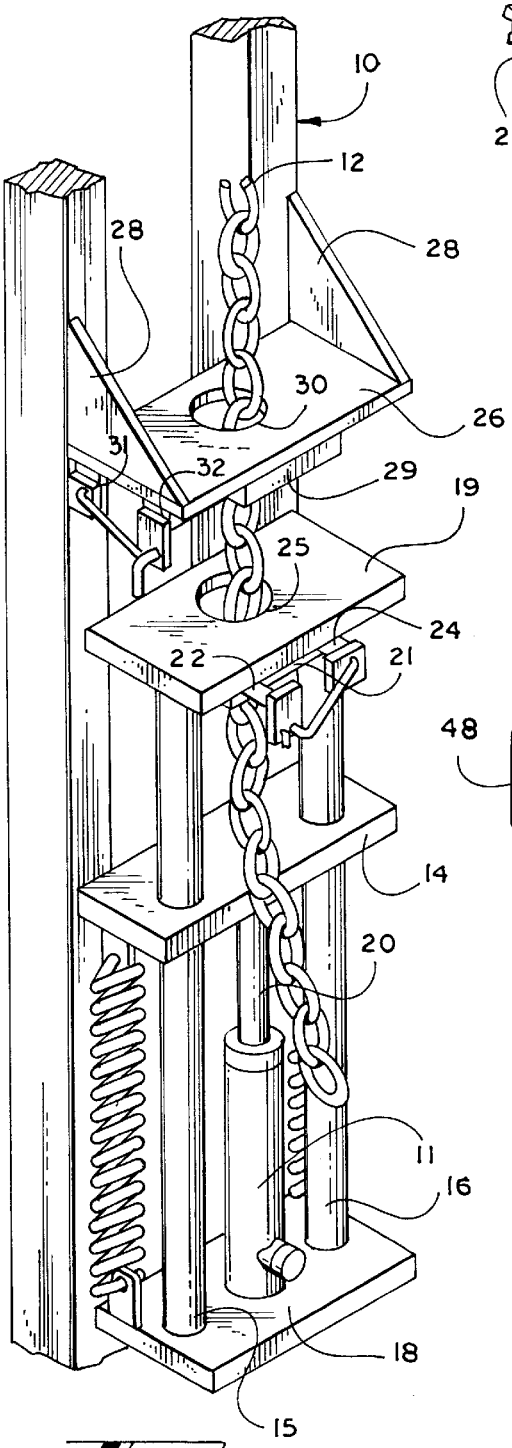
FIG. 1 is a perspective view showing a chain lock made in accordance with the present invention mounted on a pull tower.

Referring now more particularly to the drawings, and to that embodiment of the invention here presented by way of illustration, FIG. 1 shows a pull tower 10 fragmentarily, the pull tower 10 including a cylinder 11 for selectively pulling a chain 12. Those skilled in the art will understand that the chain 12 may pass over pulleys or the like to change its direction in order to make the desired pull. Such arrangements are well known in the art and are not a part of the present invention. It is also known in the art to utilize a chain lock so the chain 12 is locked to a movable member, the movable member being moved by the cylinder 11; however, the particular arrangement here shown is a unique arrangement to utilize the automatic feature of the particular chain lock.

Considering the construction of the pull tower 10 and the associated parts in more detail, there is a fixed plate 14 that is welded or otherwise permanently fixed to the pull tower 10. The plate 14 defines two holes therein for slidably receiving connecting rods 15 and 16 therethrough. The connecting rods 15 and 16 extend generally parallel to the pull tower 10, and extend down to a base plate 18 and up to a lower gate plate 19. It will be noted that the cylinder 11 has its lower end fixed to the base plate 18; and, the piston rod 20 extending from the cylinder 11 has its extending end attached to the fixed plate 14.

In view of the above described construction, it should be understood that, when the rod 20 is retracted into the cylinder 11, the base plate 18 will be at its uppermost position, and the lower gate plate 19 will be in its uppermost position because of the connecting rods 15 and 16. When the rod 20 is then projected from the cylinder 11, the base plate 18 will be moved down, causing downward motion of the lower gate plate 19.

The lower gate plate 19 carries on its bottom surface a gate 21 which will be described in more detail hereinafter. The gate 21 includes a pair of control rods 22 and 24. The lower gate plate 19 defines a hole 25 for receiving the chain 12 therethrough. The chain 12 is easily slidable through the hole 25 regardless of the orientation of the individual links of the chain. The gate 21, however, limits motion of the chain 12 through the hole 25.

Above the lower gate plate 19, there is an upper gate plate 26 that is fixed to the pull tower 10, the plate 26 including gussets 28 to reinforce the plate 26. The upper gate plate 26 also includes a gate 29 fixed to its lower surface, and defines a hole 30 that allows free movement of the chain 12 therethrough, but the gate 29 limits motion of the chain 12 through the hole 30. The gate 29 further includes a pair of control rods 31 and 32.

Figure 2:
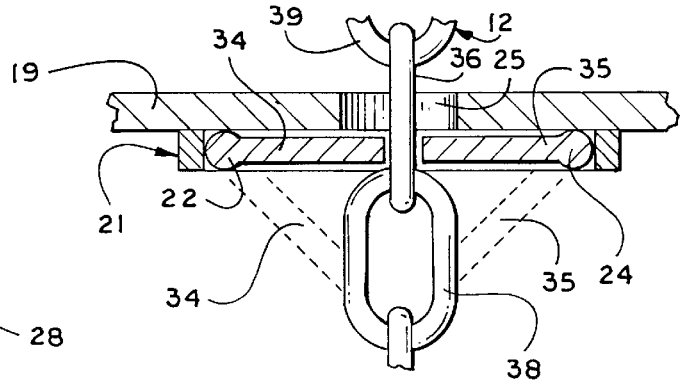
FIG. 2 is a cross-sectional view taken through one of the gates, and showing the gates in phantom lines in open position; and, FIG. 3 is a perspective view showing the two gates that make up the chain lock.

For a better understanding of the construction of the gates 21 and 29, attention is directed to FIG. 2 of the drawings. It should be understood that the two gates are similarly constructed, so the construction of both gates can be understood from FIG. 2, though the gate is designated as 21 for purposes of illustration.

The gate 21 includes two control rods 22 and 24, and flanges 34 and 35 are fixed to the control rods 22 and 24 respectively for rotation therewith. The flanges 34 and 35 are dimensioned to define a space at their extending ends to receive a link 36 of the chain 12. Thus, when a chain link is oriented as is the link 36, the flanges 34 and 35 of the gate 21 can "close", or be in their co-planar positions substantially against the plate 19. With this arrangement, the next link, link 38, abuts the bottom surfaces of the flanges 34 and 35; but, the flanges 34 and 35 cannot pivot upwardly because of the gate plate 19, so the link 38 cannot pass through the gate. Conversely, if the chain 12 is moved downwardly, the link 39 will engage the top surfaces of the flanges 34 and 35;

and, since the flanges 34 and 35 can pivot downwardly as shown in phantom, the gate will "open" to allow the chain to pass through.

Figure 3:
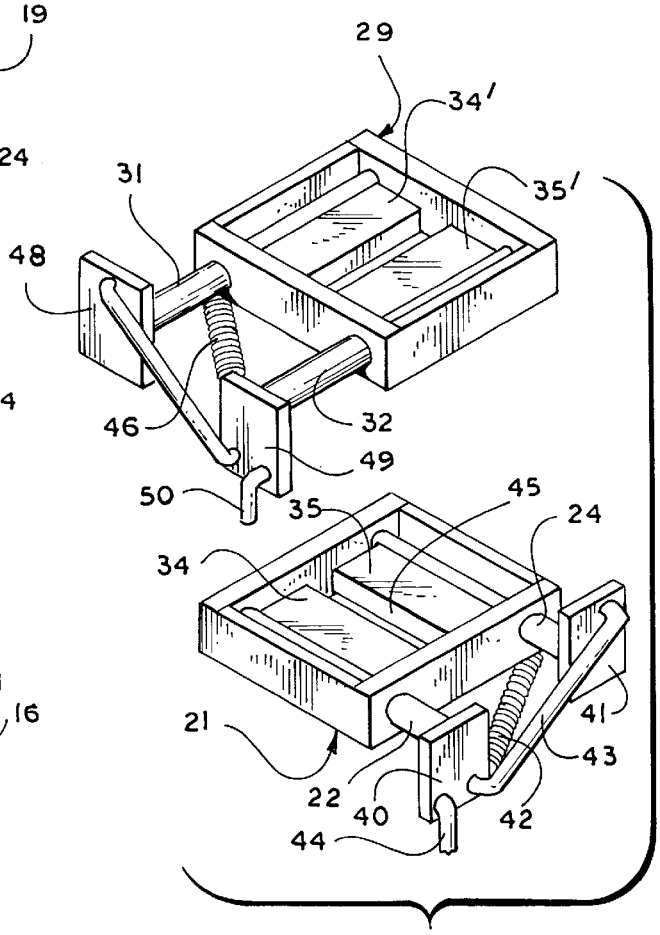

With the above understanding of the gates 21 and 29, attention is directed to FIG. 3 which shows the complete gates 21 and 29 appropriately oriented with respect to each other and including the complete operating assemblies.

The lower gate 21 has the two control rods 22 and 24 with cranks 40 and 41 attached thereto. A tie rod 42 extends between the two cranks; and, the crank 40 has a handle 44 for manual operation. Thus, as the flanges 34 and 35 pivot down as shown in FIG. 2, the cranks 40 and 41 will rotate. The tie rod 42 assures that the flanges move together. To return the flanges to their closed position as shown, there is a spring 43 fixed between the crank 40 and the gate 21. The spring 43 will therefore urge the flanges towards their closed position adjacent to the plate 19 as shown in FIG. 2.

The upper gate 29 is similar to the lower gate 21, the flanges 34' and 35' being rotated ninety degrees; and, the flanges 34' and 35' are biased towards closing by a spring 46 extending from the crank 49 to the frame of the gate 29. The crank 49 also includes a handle 50 for manual operation.

With the foregoing description in mind, operation of the chain lock of the present invention should be understood. One end of the chain 12 will be attached to a vehicle to be straightened, and the chain will pass over pulleys or the like to dispose the other end of the chain in the path shown in FIG. 1 of the drawings. The chain 12 will be pulled down until the chain is taut, the flanges of the gates 21 and 29 acting as pawls of ratchets to allow the chain to move down freely. Preferably, there will always be at least a foot of chain below the lower gate 21 so the weight of the chain will urge the chain down while the gate 21 moves up.

Those skilled in the art will understand that, when the chain lock is manufactured, the gates 21 and 29 will be carefully placed with respect to each other so one gate will lock chain links disposed in one direction, and the other gate will lock chain links disposed in a second direction that is rotated 90° from the one direction. Thus, with each gate 21 and 29 locked to a chain link, such as the link 38 in FIG. 2, fluid is admitted to the cylinder 11, and the rod 20 is projected. This causes the base plate 18 to move down; and, the connecting rods 15 and 16 pull down the lower gate plate 19 and the lower gate 21, hence the chain 12 is pulled down. As the chain 12 is pulled down, the chain will pass easily through the upper gate 29 since the flanges 34' and 35' can be pivoted down by the moving chain.

Once the piston rod 20 is at the end of its travel, and begins the return stroke, the chain 12 will tend to move up. The upper gate 29 is spring urged, so the flanges 34' and 35' will quickly close around the next properly oriented link; then, the chain cannot move up further. However, the weight of the chain will hold the end in place while the lower gate 21 moves up, the flanges 34 and 35 ratcheting along the chain 12 until the topmost position is reached, where the spring 43 will close the gate on a properly oriented chain link. The chain lock is now ready for a new stroke of the cylinder 11, and a new pull of the chain 12. It will be readily seen that the above described procedure can be repeated as long as there is enough motion of the chain to warrant operation of the cylinder 11.

It will therefore be seen that the present invention provides a chain lock that allows successive pulls on a chain without manual intervention between pulls. The device is simple and efficient with few moving parts, and is sufficiently versatile to use in virtually any straightening procedure desired. While the two gates are here shown as rotated 90° from each other, those skilled in the art will understand that the gates may be otherwise angularly related, or aligned with each other, and spaced properly so each gate will engage a proper chain link, depending on the design of the particular chain utilized.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. In a vehicle straightening apparatus including at least one pull tower, and a chain extending from said pull tower to be fixed to the vehicle to be straightened, said chain having a first group of links with a first orientation, and a second group of links with a second orientation, means for pulling said chain along said pull tower, and a chain lock for locking said chain to said means for pulling said chain, the improvement wherein said chain lock is an automatic chain lock, said automatic chain lock comprising a first gate fixed with respect to said means for pulling said chain and a second gate fixed with respect to said pull tower, each of said gates being adapted to selectively engage a link of said chain selected from the group consisting of said first group and said second group.

2. In a vehicle straightening apparatus as claimed in claim 1, said first gate and said second gate each comprising a pair of co-planar flanges, control rods pivotally mounting said flanges, said flanges defining a space therebetween for receiving a link of said chain that is aligned with said space.

3. In a vehicle straightening apparatus as claimed in claim 2, the further improvement comprising means for preventing said flanges from pivoting upwardly so that said chain cannot move up through said gate while it is free to move down through said gate.

4. In a vehicle straightening apparatus as claimed in claim 3, the improvement comprising a plate fixed to said pull tower, a base plate below said fixed plate, a first gate plate above said plate fixed to said pull tower, said first gate plate carrying said first gate, said means for pulling said chain being disposed between said fixed plate and said base plate, and a connecting rod fixed to said base plate and to said first gate plate.

5. In a vehicle straightening apparatus as claimed in claim 4, the further improvement comprising a second gate plate fixed to said pull tower above said first gate plate, said second gate plate carrying said second gate, so that said first gate plate and said base plate are movable with respect to said fixed flange and said second gate plate.

6. In a vehicle straightening apparatus as claimed in claim 5, the improvement wherein said first gate plate and said second gate plate limit upward motion of said flanges of said gates.

7. In a method for straightening a vehicle, wherein said vehicle is placed on a platform having at least one pull tower associated therewith, a chain connected to said vehicle and to said pull tower, and means on said pull tower for pulling said chain for exerting straightening forces on said vehicle, the improvement comprising the steps of engaging said chain with a first gate, moving said first gate down for pulling said chain while said chain ratchets through a second gate, engaging said chain with said second gate while moving said first gate up, said chain ratcheting through said first gate, and repeating the said step of engaging said chain with said first gate and repeating the remaining steps.

8. In a method for straightening a vehicle as claimed in claim 7, the further improvement comprising the steps of orienting said first gate to engage a first group of links of said chain, and orienting said second gate to engage a second group of links of said chain, said second group being angularly related with respect to said first group.

* * * * *